United States Patent [19]

Smith

[11] 4,086,551

[45] Apr. 25, 1978

[54] SHUNT POSITIONING DEVICE

[75] Inventor: Leonard S. Smith, Minneapolis, Minn.

[73] Assignee: Century Mfg. Co., Minneapolis, Minn.

[21] Appl. No.: 809,544

[22] Filed: Jun. 24, 1977

[51] Int. Cl.[2] ..... H01F 21/06

[52] U.S. Cl. ..... 336/45; 336/133

[58] Field of Search ..... 336/45, 130, 131, 132, 336/133, 134

[56] References Cited

U.S. PATENT DOCUMENTS 2,450,732 10/1948 Klinkhamer ..... 336/133

*Primary Examiner*—Thomas J. Kozma

*Attorney, Agent, or Firm*—Leo Gregory

[57] ABSTRACT

This invention is in connection with a sliding shunt type of welder wherein the improvement consists of the shunt being moveable relative to the core of the welder by the use of a single hand of the operator, the shunt being carried by a pair of channel members, the channel members being moveable by a single handle which by axial movement positions the shunt in a desired operating position and which by rotation operates a simple latching mechanism.

5 Claims, 5 Drawing Figures

UNLOCKED

SHUNT POSITIONING DEVICE

TECHNICAL FIELD

This invention relates to a new useful improvement in moveable shunt type of welders applying particularly to the structure for changing the operating position of the shunt to vary the current output of the welder.

RELATED ART

Reference is made to U.S. Pat. Nos. 3,394,332, 3,510,815, 3,514,732 and 3,914,726, all of said patents being owned under the ownership of the assignee herein.

Said references show various means for adjustment of the operating position of a shunt and means for locking the same in operating position and the invention herein represents a simplification and an improvement in shunt moving and locking means with respect to said references. The above references represent the closest related art known to the inventor.

BACKGROUND AND SUMMARY OF THE INVENTION

There has been a considerable development in the art of shunt type welders with respect to providing means to position and lock a shunt in operating position with a minimum amount of time and effort on the part of the operator.

It is desirable to have a very simple structure for readily positioning a shunt by the operation of a single handle member which requires the use of only one hand of an operator.

It is an object of this invention therefore to provide a shunt locking device which requires only the use of a single handle of an operator to position and lock the shunt.

It is another object of this invention to provide a shunt locking device having a shunt carried in a sliding frame member, said frame member riding over a rail carried by the core of the welder and a handle in connection with said frame member which by rotation locks said frame member against said core of the welder.

More specifically it is an object of this invention to provide a shunt positioning and locking device consisting of a pair of spaced frame members carrying a shunt therebetween, said frame members traveling over a rail formed as a part of the core of a welder, a handle extending from said frame member outwardly of the housing of the welder, said handle by rotation operates a mechanism to lock and unlock said frame member and by its axial movement positions said shunt with respect to said core.

These and other objects and advantages of the invention will be set forth in the following description made in connection with the accompanying drawings in which like reference characters refer to similar parts throughout the several views and in which.

DESCRIPTION OF A PREFERRED EMBODIMENT

Figures 1, 2, 5:
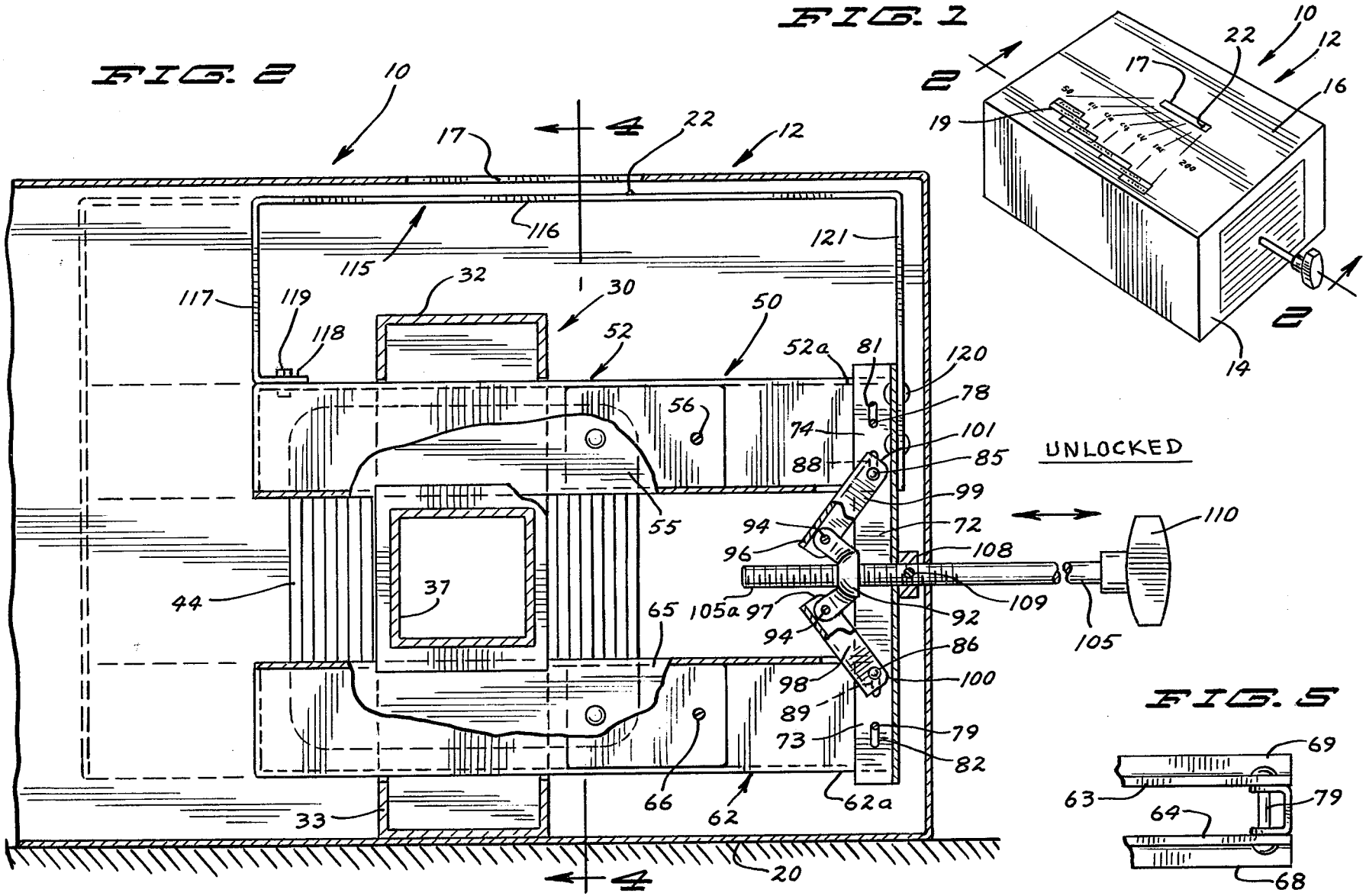
FIG. 1 is a view in perspective showing a welder comprising the device herein.
FIG. 2 is a view on an enlarged scale in vertical section taken on line 2–2 of FIG. 1 as indicated and showing one operating position.
FIG. 5 is a fragmentary view in horizontal section taken on line 5—5 of FIG. 2 as indicated.

Referring to the drawings, a shunt type of welder 10 is indicated generally and comprises a housing 12 having a front wall 12, a top wall 16 and a base or bottom wall 20. Said top wall has a slot 17 therein having an indicator 22 seen therethrough and said top wall carries indicia 19 giving an indicated current output reading in connection with said indicator.

Mounted within said housing suitably secured to said base 20 is a welding core 30. The invention herein may be applicable to various configurations of welding cores and shown here is a double E type of core comprising outer legs 32 and 33 and a center leg 37. Said legs bound windows 40 and 41. Conventional primary and secondary coils 44 and 45 are mounted in spaced relation onto said center leg 37.

Said center leg within the space 39 between said coils has a rail 47 thereacross in the form of a shallow U-channel as shown and a like rail 48 vertically aligned therewith formed across the bottom thereof. In spaced opposed relation to said rails respectively are outer legs 32 and 33.

Now will be described the shunt carrying and locking means 50 which comprises the structure of the invention herein.

Said means 50 is shown consisting of a pair of shunting members 52 and 62.

Shunting member 52 is formed of a pair of elongated transversely spaced parallel plate members 53 and 54 having a shunt member 55 secured therebetween substantially centrally longitudinally thereof by rivets 56. In operating position, as here shown, said plate members may be described as being horizontally disposed. The upper longitudinal edge portions of said plate members are formed to have outwardly right angled flanges 58 and 59.

Figure 3:
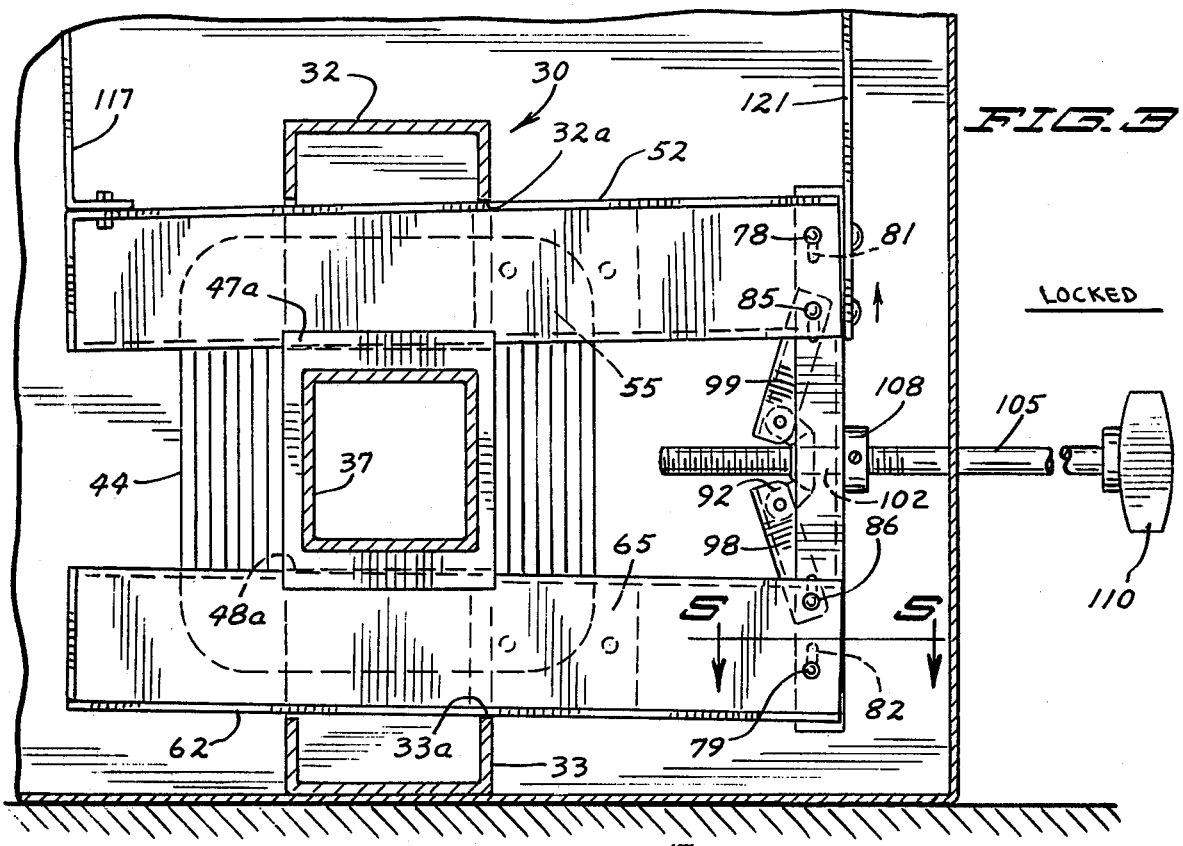
FIG. 3 is a view similar to FIG. 2 showing an alternate position of a portion thereof showing another operating position.
Figure 4:
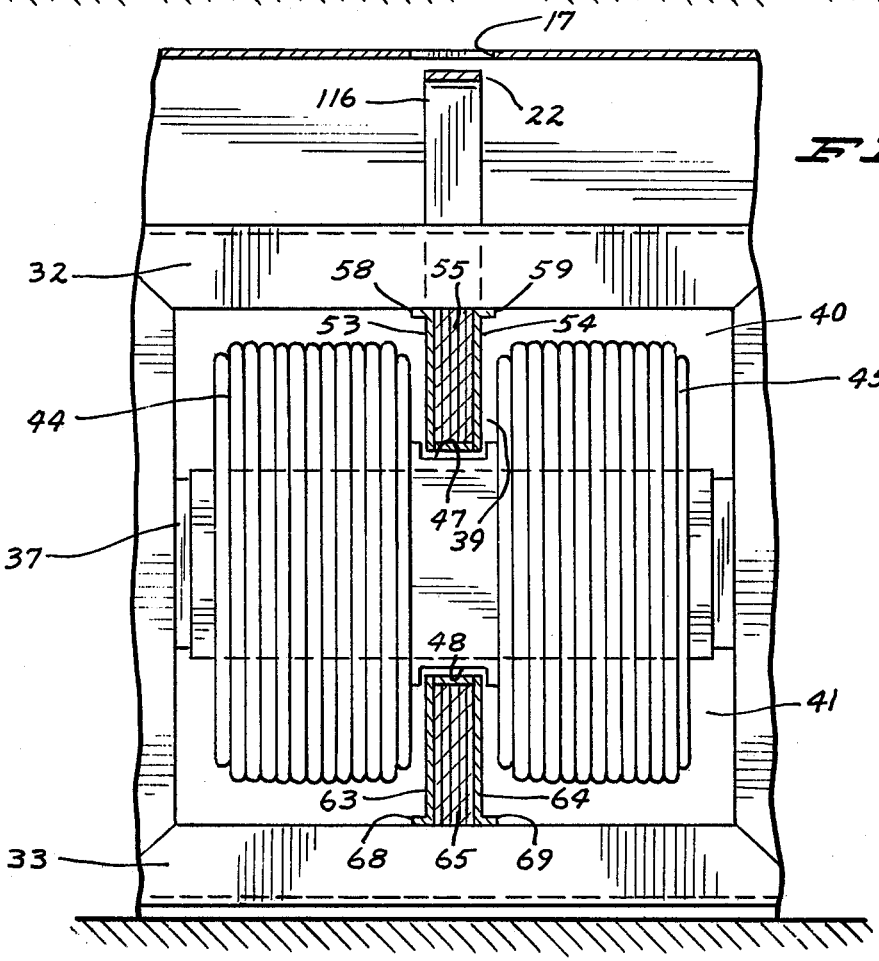
FIG. 4 is a fragmentary view in vertical section taken on line 4—4 of FIG. 2 as indicated.

In vertical alignment with said shunt member 55 spaced therebelow is said shunt member of 62 of like construction oppositely disposed having a pair of spaced plate members 63 and 64 having a shunt member 65 therebetween secured by rivets 66. The lower longitudinal edge portions of said plate members have outward right angled flanges 68 and 69. An elongated U-channel member 72 holds the frame members 52 and 62 in vertically spaced relation having its end portions 73 and 74 disposed between the spaced end portions **52*a* and 62*a* respectively of said frame members as shown in FIGS. 2 and 3 and is secured therebetween by rivets 78 and 79. Said channel member has vertically elongated slots 81 and 82 through which said rivets pass providing movement of said frame members relative to said channel member 72**, said frame members being moved toward and away from one another as will be described.

Spaced somewhat inwardly respectively of said rivets 78 and 79 are rivets 85 and 86 also passing through the end portions of **52*a* and 62*a* of said frame members and through accommodating elongated slots 88 and 89 in said channel member 72**.

Pivotally connected to a wing nut 92 by rivets 94 through adjacent ends 96 and 97 thereof are a pair of plate link members 98 and 99 having their remote ends 100 and 101 pivoted by said rivets 85 and 86 to said channel member 72.

Extending through an aperture 102 in said channel member 72 centrally longitudinally thereof is a bolt 105 which is threaded through said wing nut 92 and said bolt is secured against inward axial movement relative to said channel member by a locking nut 108 which may be secured to said bolt as by a pin 109. Said bolt has a handle 110. Said bolt has a portion 105*a* which extends inwardly of said channel member 72 just sufficiently to act as a stop member against the leg 37 when the shunts are fully within the core 30.

It is seen that the shunt carrying members 62 and 63 are carried by said channel member 72 in cantilevered positions.

In operating position, as illustrated, the frame member 52 is disposed across the rail 47 and the frame member 62 is disposed across the rail 48 as best shown in FIGS. 2 and 3. It will be understood that with said frame members positioned as described, between each of said frame members and there respective rails on one hand and their respective opposing surfaces of the outer legs 32 and 33 on the other hand, their will be a clearance on the order of 0.050 inches. There is thus just sufficient clearance for free sliding movement of said frame members across said rails.

An overhead strap member 115 is carried by said frame member 52, said strap member having a horizontal overhead portion 116, having one right angled end leg 117 secured at a lower angled end portion 118 thereof by a bolt 119 as to the upper flange surface of the adjacent portion of the inner end of said member 52 as shown and having its other right angled leg 121 overlying the upper portion of the outer side of channel member 72 as shown and being secured thereto by bolts or rivets 120. Carried on said upper portion 116 is said indicator 22 which will be distinctively colored to be readily seen through the slot 17 and the same will be positioned and calibrated with the current output of the welder as will be indicated by the indicia 19 with regard to the position of the shunts 55 and 56. This is a matter of design.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A shunt positioning and locking means for a welding apparatus having in combination a core having a primary and a secondary coil mounted therein in spaced relation, shunt holding means moveably disposed between said coils, means formed by said core supporting said shunt holding means, said shunt holding means comprising a pair of spaced frame members, an elongated connecting member at one end of said frame members, means moveably connecting said spaced frame members to said connecting member for movement of said frame members relative to said connecting member in directions toward or away from each other, a rod disposed through said connecting member spaced between said frame members having axial movement normal to the plane of said connecting member relative thereto, means linking said rod with each of said frame members moving said frame members toward and away from each other by axial movement of said rod and said second mentioned means comprising surface portions opposed to each of the adjacent and to each of the remote sides of said frame members and each of said frame members having small clearance between their respective opposed surface portions.

2. The structure set forth in claim 1, wherein a threaded member carried by said rod to the side of said connecting member facing said core, said link means comprises a pair of link members having their adjacent ends pivoted to said threaded member and having their remote ends respectively pivoted to said frame members, whereby rotation of said rod in one direction moves said threaded member to cause said link members to respectively move said frame members for locking engagement with their respective opposed surface portions of said core.

3. The structure set forth in claim 2, wherein means carried by said rod prevents relative axial movement between said rod and said connecting member with respect to rotation of said rod in one direction.

4. The structure set forth in claim 2, wherein said link members have their remote ends pivoted respectively to said frame members through said connecting member for relative movement between said link members and said connecting member.

5. The structure set forth in claim 1, including a housing having said core and said frame members disposed therein said housing carrying indicia to give an indicated output reading, and means carried by one of said frame members indicating output in connection with said indicia.

* * * * *